US006568925B2

(12) United States Patent
Gunderson

(10) Patent No.: US 6,568,925 B2
(45) Date of Patent: May 27, 2003

(54) ABRASIVE LIQUID PUMP APPARATUS AND METHOD

(76) Inventor: Eric Gunderson, P.O. Box 363, Goshen, NH (US) 03752

( * ) Notice: Subject to any disclaimer, the term of this patent is extended or adjusted under 35 U.S.C. 154(b) by 49 days.

(21) Appl. No.: 09/819,196

(22) Filed: Mar. 28, 2001

(65) Prior Publication Data

US 2002/0141891 A1 Oct. 3, 2002

(51) Int. Cl.[7] ..... F04B 39/10; F04B 53/12

(52) U.S. Cl. ..... 417/545; 417/396; 417/555.1; 417/900; 92/86.5

(58) Field of Search ..... 417/545, 546, 417/396, 404, 540, 552, 900, 403, 555.1; 222/326, 386, 389; 92/240, 242, 243, 244, 253, 85.6, 168, 86.5

(56) References Cited

U.S. PATENT DOCUMENTS

| | | | | |
|---|---|---|---|---|
| 4,035,109 A | | 7/1977 | Drath et al. | |
| 4,087,209 A | * | 5/1978 | Mahig et al. | 417/268 |
| 4,304,527 A | | 12/1981 | Jewell et al. | |
| 4,347,033 A | | 8/1982 | Possell | |
| 4,459,899 A | | 7/1984 | Richardson | |
| 4,476,771 A | * | 10/1984 | Kao | 92/78 |
| 4,519,753 A | * | 5/1985 | Kitsnik | 417/403 |
| 4,521,163 A | | 6/1985 | Stahlkopf | |
| 4,543,044 A | | 9/1985 | Simmons | |
| 4,598,630 A | | 7/1986 | Kao | |
| 4,599,053 A | | 7/1986 | Fejmert | |
| RE32,646 E | | 4/1988 | Wentworth | |
| 4,789,313 A | | 12/1988 | Tower et al. | |
| 5,094,596 A | | 3/1992 | Erwin et al. | |
| 5,267,830 A | | 12/1993 | Wickoren et al. | |
| 5,312,028 A | | 5/1994 | Hume | |
| 5,632,607 A | * | 5/1997 | Poothodiyil | 417/225 |
| 5,765,963 A | | 6/1998 | Roberts | |

FOREIGN PATENT DOCUMENTS

| | | |
|---|---|---|
| EP | 0354883 A1 | 2/1990 |
| EP | 0580196 A1 | 1/1994 |

* cited by examiner

*Primary Examiner*—Charles G. Freay
*Assistant Examiner*—Han L. Liu
(74) *Attorney, Agent, or Firm*—Robert R. Deleault, Esq.; Mesmer & Deleault, PLLC

(57) ABSTRACT

An abrasive liquid pump having a pump housing and a piston component configured for slidable movement within the pump housing. The pump housing has a bottom housing portion with a bottom end and a bottom mid-pump end and a top housing portion with a top end and a top mid-pump end. The top portion is removably attached to the bottom portion. The piston component has a top piston assembly on one end having at least one sealing component for sealable engagement against an inner surface of the top housing portion and a bottom piston assembly on the other end having at least on sealing component for sealable engagement against an inner surface of the bottom housing portion.

24 Claims, 6 Drawing Sheets

ABRASIVE LIQUID PUMP APPARATUS AND METHOD

BACKGROUND OF THE INVENTION

1. Field of the Invention

The present invention relates generally to high-pressure piston pumps especially adapted for pumping abrasive fluent materials. Particularly, the present invention relates to high-pressure piston pumps for the spray application of highly viscous and abrasive liquid materials.

2. Description of the Prior Art

The spray application of highly viscous liquids and those liquids containing relatively high amounts of abrasive filler material such as industrial coatings has become well known. To provide the high pressure required for these spray applications, various pump designs have been devised. These pump designs incorporate either hydraulic driven piston pumps, hydraulic driven diaphragm pumps or air-operated dual diaphragm pumps.

In hydraulic driven piston pumps, the typical technique utilizes a single piston/cylinder arrangement in which a drive fluid, for example oil, is located on one side of the piston while the abrasive fluid being pumped is located on the other side of the piston. At present, existing pump arrangements of this type can operate at pressures up to 20,000 psi with reasonable reliability. Variations of this design have led to pump designs that incorporate and utilize an output pump and a separate drive pump which are interconnected through a common chamber containing a drive fluid.

U.S. Pat. No. 4,789,313 (1988, Tower et al.) discloses a device that utilizes an output pump and a separate drive pump which are interconnected through a common chamber containing a drive fluid. The output pump includes an output piston within its own pumping chamber for pumping the output liquid by causing the output piston to move through a complete forward stroke. The drive pump includes a drive piston within its own chamber and means for causing the output piston to move the drive piston through its own complete forward stroke. This pressurizes the drive fluid within the common chamber in a way which causes the output piston to move in the forward direction of its stroke. The two pumps are configured such that the forward stroke of the drive piston defines a greater swept volume than the forward stroke of the output piston. This ensures that the output piston will always move through its entire forward stroke before the drive piston.

U.S. Pat. No. 4,598,630 (1986, David T. Kao) discloses a double acting self-flushing pump. The double action slurry pump is provided having a self-flushing piston assembly mounted in a mating cylinder. The piston assembly includes a first piston having a peripheral sealing means and a reciprocating piston rod for driving the first piston. Second and third power pistons mounted adjacent opposite sides of the first piston include sealing discs and form respective first and second chambers with the first piston and the adjacent cylinder wall. The second and third pistons serve to pump the slurry on the sides opposite the flushing fluid chambers. Each of the pumping pistons includes hollow carriers that cooperate with shoulders fixed to the piston rod to provide limited lost motion movement. The resulting lost motion serves to vary the size of the first and second chambers.

U.S. Pat. No. 5,094,596 (1992, Erwin et al.) discloses a pump assembly comprised of a pair of opposed single acting piston pumps operated alternatively by an interposed reciprocal actuator. Each pumping chamber has aligned inlet and outlet check valves in its peripheral wall that defines a straight line path of fluid flow diametrically through the chamber. The piston has its periphery spaced from the peripheral wall of the pumping chamber to provide a relatively short stroke to maintain the straight line path of fluid flow through the chamber. There is an annular seal extending from the peripheral wall toward the piston and bridging the gap between the periphery of the piston and the peripheral wall of the pumping chamber.

U.S. Pat. No. 5,312,028 (1994, James M. Hume) discloses a single stroke pressure viscous liquid pump that includes an upright liquid tank having an open upper end positioned atop a base plate of a frame in coaxial alignment spaced directly beneath a pressure cylinder which includes an axially movable ram having a piston at its lower end. The piston is sized to sealingly engage the inner surface tank whereby downward axial force generated by the ram is transmitted directly against the upper surface of the liquid within the tank. A discharge outlet near the bottom of the tank is connectable to a conduit and liquid spray nozzle. Only a single stroke of the ram is required at a very slow feed rate to empty the tank of liquid thus eliminating virtually all heat buildup.

On one brand of abrasive liquid spraying unit sold by Neal now owned by Ingersold-Rand, there is used a dual piston pump known as the Blaw-Knox SP or Blaw-Knox SSP pump that includes a piston unit having a piston on one end of a piston rod and a second, smaller piston at the other end, each with appropriate piston seals. The piston is within a single unit pump housing having an upper and lower section. The upper section has a smaller diameter than the lower section and houses the small piston. The lower section houses the larger piston which has a check valve situated on the piston rod adjacent the larger piston. The piston rod check valve allows the abrasive liquid to flow from one side of the larger piston to the other. The lower section further includes an abrasive liquid outlet located through the wall of the lower housing portion nearer the junction between the lower and upper housing sections. The abrasive liquid inlet is located on the lower housing end plate. The capability of the Blaw-Knox SP pump and SSP pump is 50 gallons per minute and 100 gallons per minute, respectively.

A disadvantage of the prior art is that the abrasive liquid tends to prematurely wear out the piston seals causing leakage past the upper piston seals, reduced flow throughput of the abrasive liquid, and reduced operating pressure. When the seals fail, the entire piston unit must be removed from the pump housing. This requires removal and disconnection of the hydraulic pump head from the upper section of the housing, of the fluid outlet coupler from the side of the pump housing and of the fluid inlet plate from the lower section pump housing end. The entire piston unit must then be completely removed from the pump housing and the entire pump housing replaced to effect piston seal replacement, even when only the upper piston seals are leaking caused by wear on the seals and on the inside surface of the upper pump housing portion. This type of repair must be done at the company's shop. This is time consuming and costly because of the downtime for the spray system and because of the replacement of the entire pump housing when the lower pump portion is still functional and not worn.

Even though an abrasive liquid pump is still operable when the seals begin to leak, the pump must be operated at a lower speed to prevent a complete breakdown of the piston seals. This is a particular disadvantage when a sealing spray system is used to seal a large area such as sealing a large asphalt parking lot. This causes the sealing operation to take much longer than anticipated and to subsequently increase the cost of performing the sealing operation. In the event of a seal breakdown that renders the pump inoperable to continue using the sealing spray system, as stated previously, the entire sealing spray system must be transported to the company's shop to effect a repair.

Therefore, what is needed is an abrasive liquid pump that can be repaired at the job location. What is further needed is an abrasive liquid pump that is less costly to replace the worn seals on the piston unit within the pump housing. What is still further needed is an abrasive liquid pump that does not require replacement of the entire pump housing when the upper seals are worn. What is yet further needed is an abrasive liquid pump that does not have to be completely removed from the sealing spray system to effect a leaking seal repair.

SUMMARY OF THE INVENTION

It is an object of the present invention to provide an improved pump housing structure for an abrasive liquid pump that permits the repair of an abrasive liquid pump at the spray-coating job location. It is another object of the present invention to provide an improved pump housing for an abrasive liquid pump that makes it less costly to replace the worn seals on the piston unit and to replace the pump housing. It is a further object of the present invention to provide an improved pump housing for an abrasive liquid pump that does not require the complete removal of the abrasive liquid pump from the sealing spray system to effect a leaking seal repair.

The present invention achieves these and other objectives by providing a two-piece abrasive liquid pump housing that includes an upper pump housing section and a lower pump housing section having a larger inside diameter than the upper pump housing section and that the lower pump housing section is removably attached to the upper housing section. Within the abrasive liquid pump housing, there is a piston rod having a first piston assembly on a first end and a second piston assembly on a second end where the second piston assembly has a larger diameter than the first piston assembly. The piston rod also includes a check valve spaced from the second end adjacent to the second piston assembly. The lower pump housing section also includes an fluid outlet through the wall of the lower pump housing section spaced a predetermined distance from the junction between the lower pump housing section and the upper pump housing section.

The upper pump housing section has a hydraulic pump end and a lower pump housing end. The hydraulic pump end is adapted to be removably connected to a hydraulic pump that provides a hydraulic pump shaft for connection to the piston rod of the abrasive liquid pump. The lower pump housing end is adapted to be removably connected to the lower pump housing section at the end nearest the fluid outlet. A seal is preferably used between the upper pump housing section and the lower pump housing section. The opposite end of the lower pump housing is adapted to be removably connected to a lower housing end cap. The lower housing end cap incorporates a fluid inlet and an inlet check valve.

Because the majority of seal wear occurs at the first piston assembly with associated cylinder wear, the upper pump housing section of the present invention can be easily removed without disconnecting the fluid inlet and outlet connections and without removing the entire abrasive pump from the sealant spray system. Further the piston rod does not have to be removed from the pump housing. The hydraulic power unit is removed from the end of the upper pump housing section and then the upper housing section is removed from the lower pump housing section. By removing just the upper pump housing section, the first piston assembly seals are exposed and can be easily repaired by simply removing the first piston assembly retaining nut(s). New seals are replaced for the old, worn-out seals and the first piston assembly retaining nut(s) are re-connected. A new, replacement, upper pump housing section is re-attached to the lower pump housing section and the hydraulic pump unit is re-attached. The abrasive liquid pump is then ready to operate.

DETAILED DESCRIPTION OF THE PREFERRED EMBODIMENT

Figure 1:
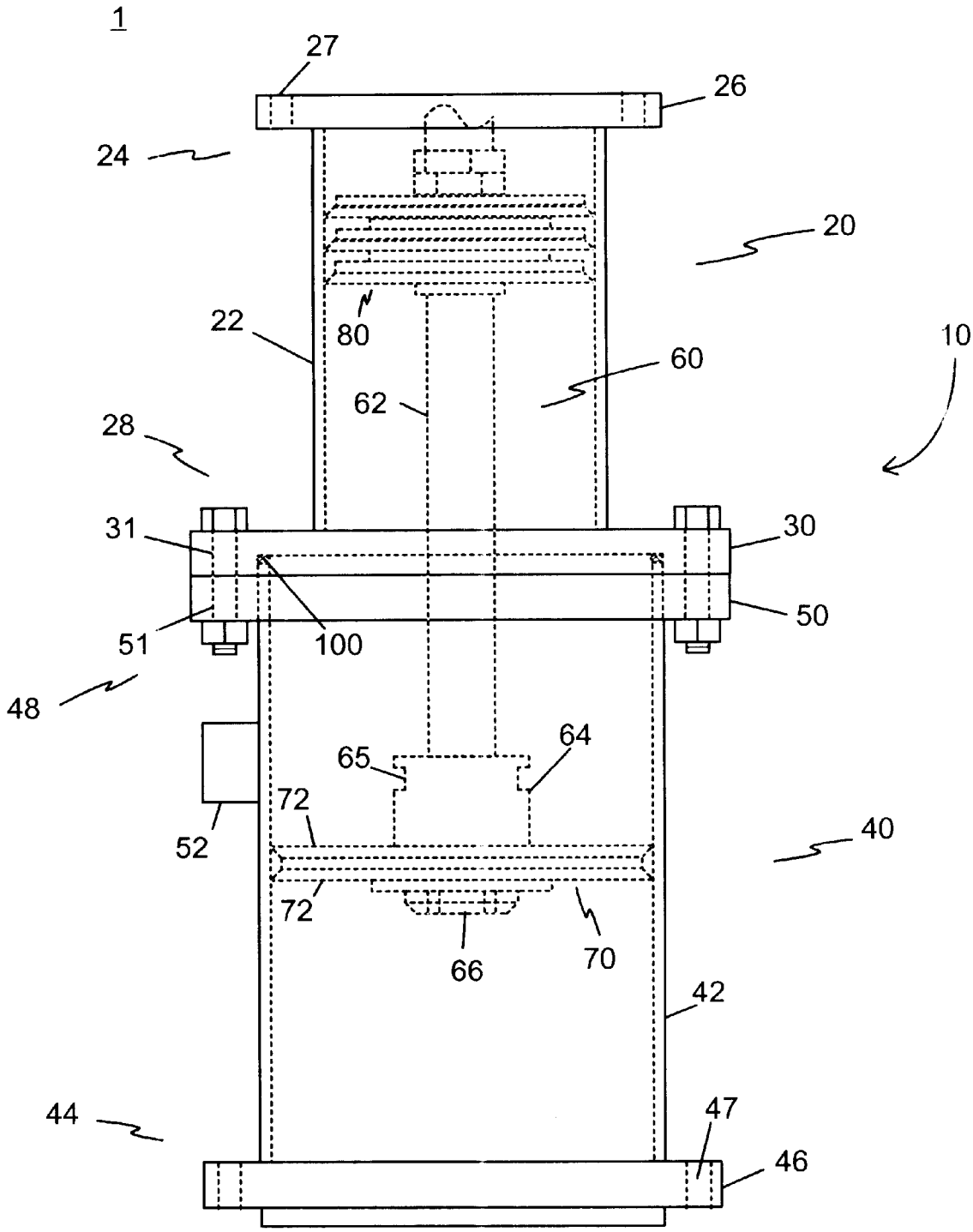
FIG. 1 is a side view of a pump showing the pump housing of the present invention.

The preferred embodiment of the present invention is illustrated in FIGS. 1–6. FIG. 1 shows a side view of pump 1 showing pump housing 10 of the present invention. Pump housing 10 includes a top housing portion 20 removably attached to a bottom housing portion 40. Top housing portion 20 comprises a top cylindrical tube 22 having a first top end 24 and a second top end 28. First top end 24 includes a drive mechanism retaining ring 26 that has, preferably, a plurality of bolt holes 27 in its periphery for fastening pump housing 10 to a drive mechanism (not shown). Second top end 28 includes a top mid-pump retaining ring 30 that has, preferably, a plurality of mid-pump bolt holes 31 in its periphery for fastening top housing portion 20 to bottom housing portion 40. It should be understood that any type of fastening mechanism may be used to secure top housing portion 20 to bottom housing portion 40 and that the use of bolt holes and bolts is merely the preferred method of fastening top housing portion 20 to bottom housing portion 40. A seal 100 may be used between top housing portion 20 and bottom housing portion 40. Because all of the mating surfaces have machined finishes, it is not necessary to use seal 100 but may be preferred to provided additional assurance that a leak between top housing portion 20 and bottom housing portion 40 does not occur.

Bottom housing portion 40 comprises a bottom cylindrical tube 42 having a first bottom end 44 and a second bottom end 48. First bottom end 44 includes an inlet ring 46 that has, preferably, a plurality of bolt holes 47 in its periphery for fastening pump housing 10 to a liquid inlet source (not shown). Second bottom end 48 includes a bottom mid-pump retaining ring 50 that has, preferably, a plurality of mid-pump bolt holes 51 in its periphery. Mid-pump bolt holes 51 are positioned to align with mid-pump bolt holes 31 for fastening top housing portion 20 to bottom housing portion 40. Bottom housing portion 40 also includes an outlet 52 through bottom cylindrical tube 42 spaced from bottom mid-pump retaining ring 50.

Within pump housing 10 there is piston component 60 that undergoes an upward and downward movement when the completely assembled pump (i.e. when inlet ring 46 is connected to an abrasive liquid source, when drive mechanism retaining ring 26 is connected to drive mechanism such as a hydraulic power head, and outlet 52 is connected to an abrasive liquid dispensing nozzle assembly, all as is well known in the art) and is operated. Piston component 60 includes a piston rod 62 that has a first piston assembly 70 on one end and a second piston assembly 80 on the other end. First piston assembly 70 is sized to sealably engage against the inner surface of bottom cylindrical tube 42 and includes one or more first piston seals 72. Adjacent first piston assembly 70 and as a component part attached to or made integrally with piston rod 62 is check valve 64. Check valve 64, which is typically a ball check valve as is commonly used in the art, allows the pumping liquid to conditionally pass from one side of first piston assembly 70 through a check valve inlet 66 to the other side of first piston assembly 70 through a check valve outlet 65 when the pump is operated.

Top cylindrical tube 22 is preferably made from steel tubing having an inside diameter of about 5.75 inches. Bottom cylindrical tube 42 is also preferably made from steel tubing having an inside diameter of about 8.00 inches. Drive mechanism retaining ring 26, top mid-pump retaining ring 30, inlet ring 46, and bottom mid-pump retaining ring 50 are preferably made from steel plate having a ½ inch typical thickness. Outlet 52 is preferably a two-inch diameter steel coupler. Bolt holes 27, 31, 47, and 51 are preferably sized to accept 7/16 inch NC Typ bolts.

Figure 2:
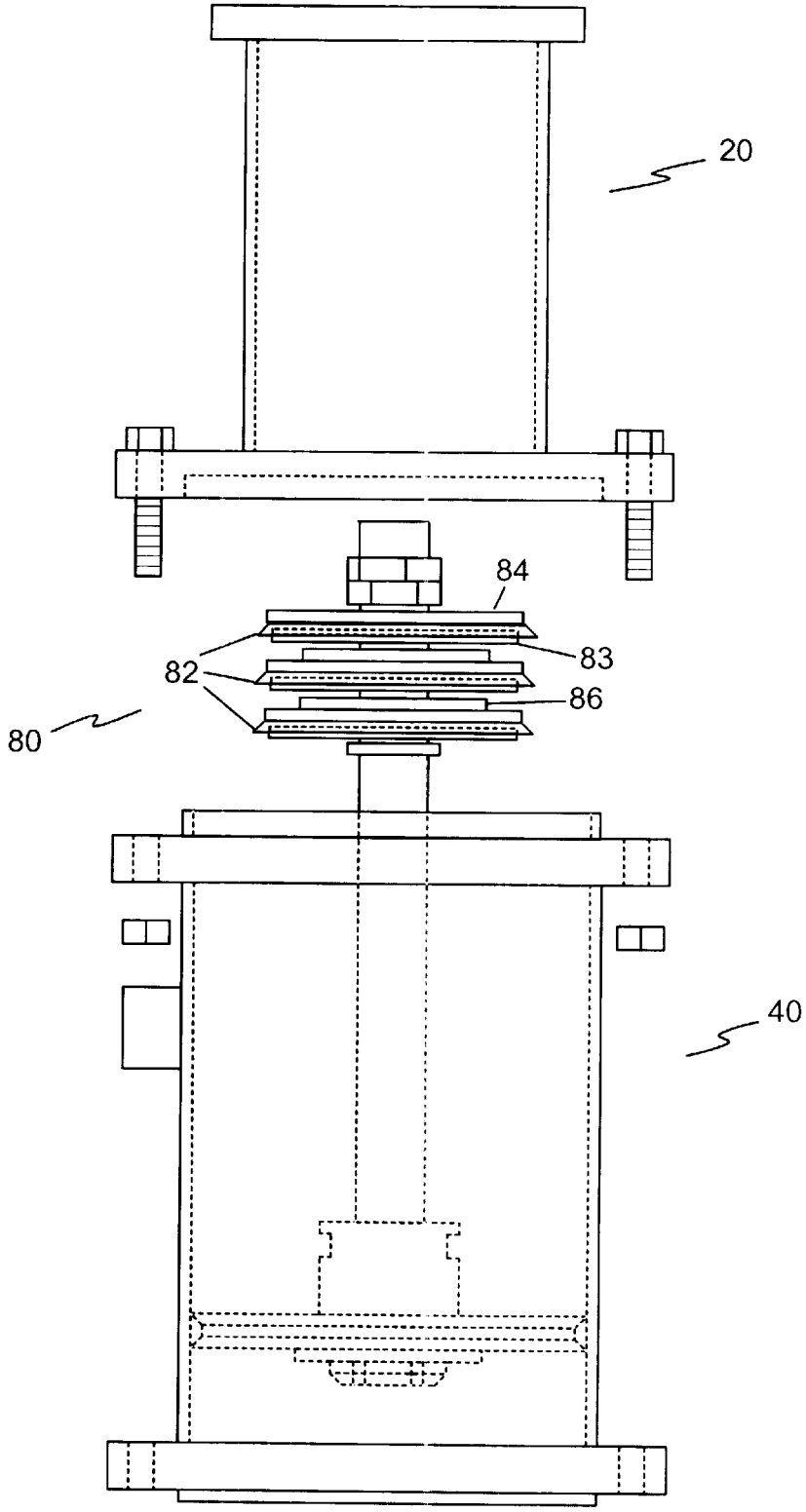
FIG. 2 is a side view of a pump showing the top housing portion of the present invention separated from the bottom housing portion.

FIG. 2 shows a side view of pump housing 10 with top housing portion 20 separated from bottom housing portion 40 exposing second piston assembly 80. Second piston assembly 80 is separated into it component parts to better visualize the components of the piston assembly. Second piston assembly 80 includes first, second and third top leather cup seals 82, and first, second and third top beveled rings 83 where each are positioned adjacent the cup side of first, second and third top leather cup seals 82, respectively. Each one of a first, second and third top spacers 84 are positioned opposite the cup side of first, second and third top leather cup seals 82. A first and second washer 86 are positioned between first top spacer 84 and second top beveled ring 83, and between second top spacer 84 and third top beveled ring 83, respectively. Generally, it is the first, second and third top leather cup seals 82 that become worn with pump use.

Figure 3:
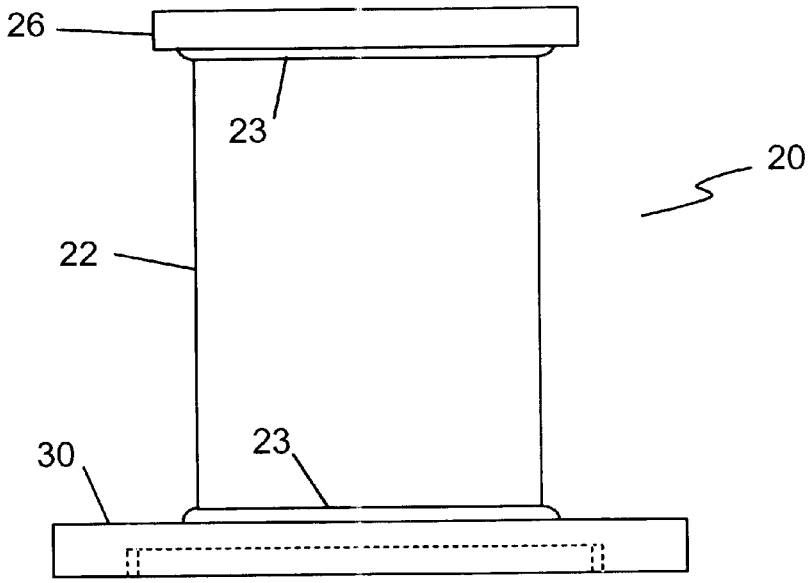
FIG. 3 is a side view of the top portion of the pump housing of the present invention.
Figure 3A:
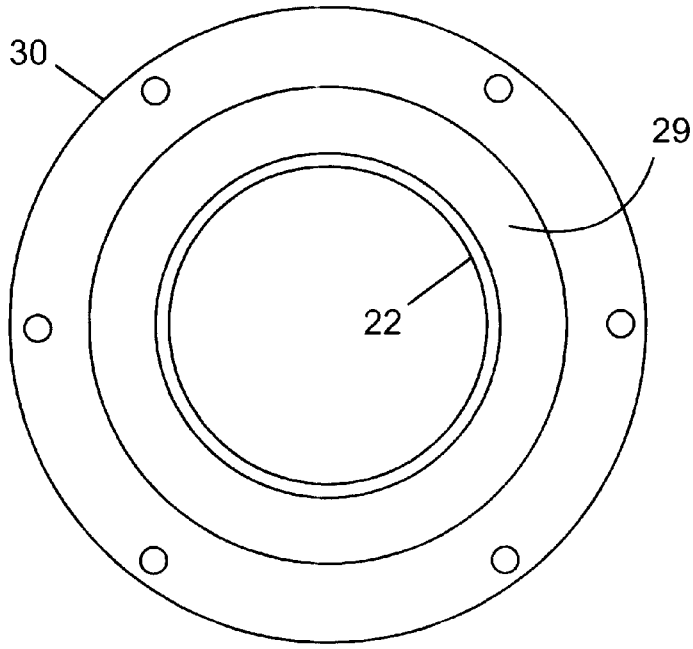
FIG. 3A is a bottom view of the top portion of the pump housing of the present invention showing the top mid-pump retaining ring with a recess.
Figure 4A:
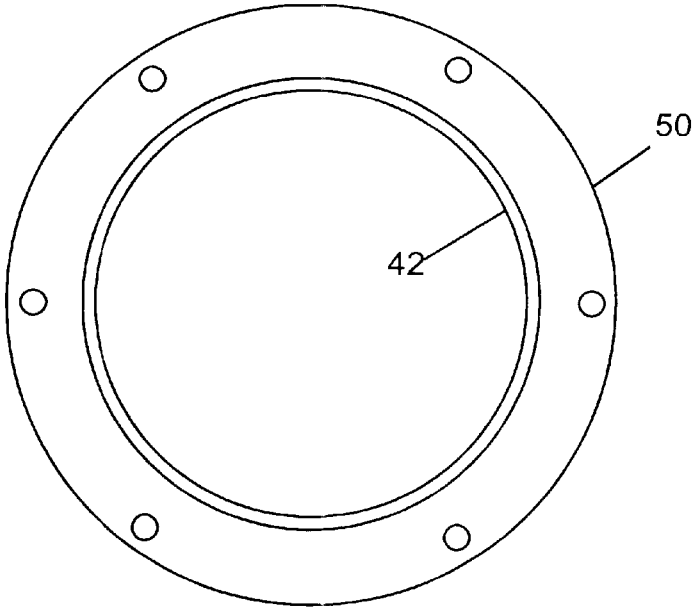
FIG. 4A is a top view of the bottom portion of the pump housing of the present invention showing the bottom mid-pump retaining ring.
Figure 4:
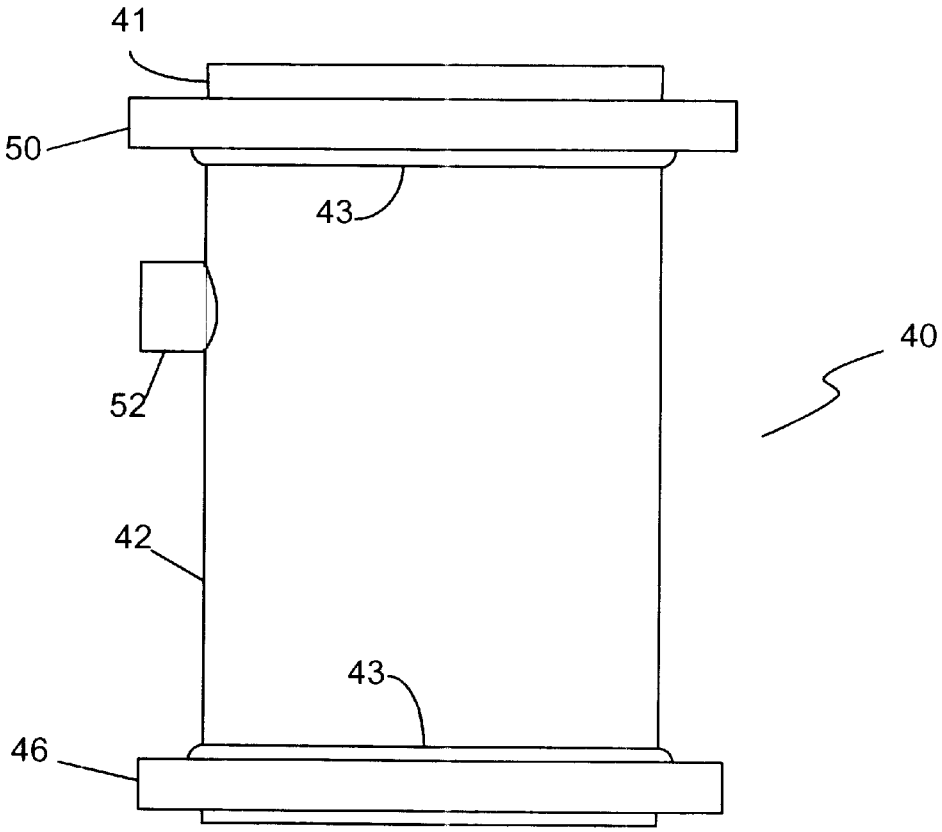
FIG. 4 is a side view of the bottom portion of the pump housing of the present invention.

FIG. 3 is a side view of top housing portion 20. Drive mechanism retaining ring 26 and top mid-pump retaining ring 30 are secured to top cylindrical tube 22 preferably using a welded bead 23 around the periphery of top cylindrical tube 22. FIG. 3A shows the bottom view of top housing portion 20 from the second top end 28. Top mid-pump retaining ring 30 includes a recess 29 sized to receive bottom cylindrical tube 42. The depth of recess 29 is preferably about ¼ inch to about ⅜ inch deep. FIG. 4 is a side view of bottom housing portion 40 with a top flange 41. Inlet ring 46 and bottom mid-pump retaining ring 50 are also secured to bottom cylindrical tube 42 preferably using a welded bead 43 around the periphery of bottom cylindrical tube 42. FIG. 4A is a top view of bottom housing portion 41 showing the bottom mid-pump retainer ring 50, the bottom cylindrical tube 42 and the bolt holes 51.

Figure 5:
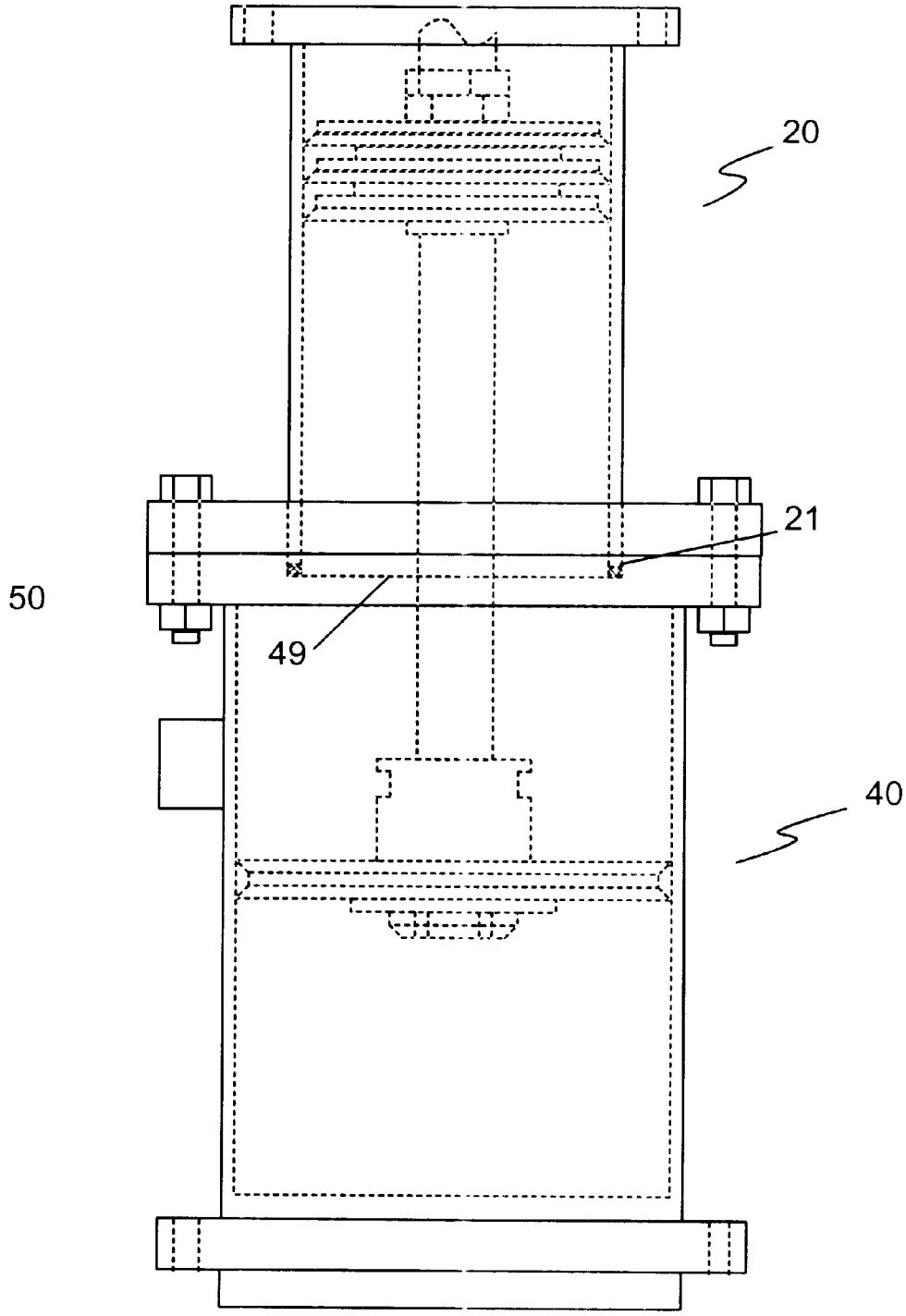
FIG. 5 is a side view of another embodiment of the pump housing of the present invention showing the recess in the bottom mid-pump retaining ring and the mating flange on the top housing portion.
Figure 6:
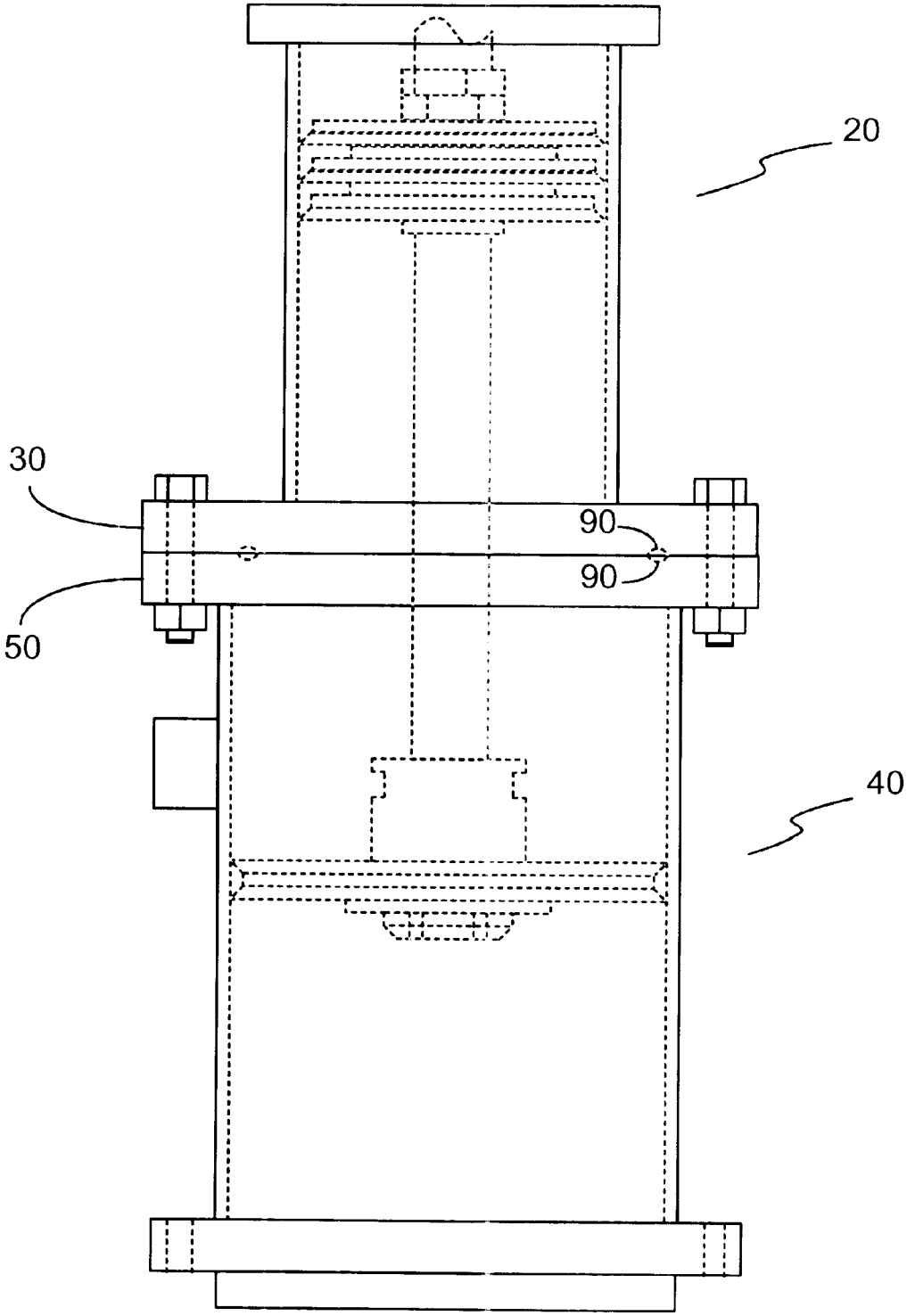
FIG. 6 is a side view of another embodiment of the pump housing of the present invention showing a ring seal between the top and bottom housing portions.

FIG. 5 shows an alternative embodiment of the present invention where the component parts of the pump housing 10 are the same except for the junction between top housing portion 20 and bottom housing portion 40. In this embodiment, bottom mid-pump retaining ring 50 has a recess 49 and top housing portion 20 has an extending flange 21. FIG. 6 shows yet another embodiment of the present invention where the component parts of pump housing 10 are the same except that neither top housing portion 20 nor bottom housing portion 40 includes a flange at their junction. In this embodiment, either the top mid-pump retaining ring 30 or the bottom mid-pump retaining ring 50, or both, have a seal receiving recess 90 for receiving a sealing material when assembling top housing portion 20 to bottom housing portion 40.

To make the pump housing 10, one begins by obtaining two different sizes of steel tubing, one having an inside diameter of about 5.75 inches with an outside diameter of about 6.25 inches to form top cylindrical tube 22 and another having an inside diameter of about 8.00 inches with an outside diameter of about 8.5 inches to form bottom cylindrical tube 42. Top cylindrical tube 22 is cut approximately twelve inches long. Bottom cylindrical tube 42 is cut approximately sixteen inches long. Next, ½ inch steel sheet stock is cut or machined into cylindrical rings having a diameter of about 8.5 inches to form drive mechanism retaining ring 26, and a diameter of about 10.25 inches to form top mid-pump retaining ring 30, inlet ring 46, and bottom mid-pump retaining ring 50. Typically, the cylindrical rings are rough cut to the intended diameter and then machined to size (8.5 inches or 10.25 inches). This is also true for the top and bottom cylindrical tubes 22 and 42. In addition, a two-inch hole is cut or machined through the side wall of bottom cylindrical tube 42. The center of the two-inch hole is approximately two and a half (2.5) inches from one end of tube 42.

A hole having a diameter of about 5.75 inches is machined or cut through drive mechanism retaining ring 26 and top mid-pump retaining ring 30 such that each ring 26 and 30 fits on the ends of top cylindrical tube 22. For alignment purposes, a shallow indexing recess (not shown) is machined or cut into one side of drive mechanism retaining ring 26 and top mid-pump retaining ring 30. The shallow indexing recess has a diameter about equal to the outside diameter of top cylindrical tube 22 and has a depth sufficient only to serve as a self-aligning mechanism for attaching the rings 26 and 30 to the ends of tube 22 described below. A recess having a diameter of about 8.5 inches and a depth of about ¼ inch to about ⅜ inch is also machined into one surface of top mid-pump retaining ring 30. In the preferred embodiment, four bolt holes having a ½ inch diameter are drilled or cut and positioned around the perimeter of drive mechanism retaining ring 26 such that they align and mate with the drive mechanism (not shown) of pump 1. Six bolt holes having the ½ inch diameter are drilled or cut and equally spaced from each other around the perimeter of top mid-pump retaining ring 30. Bottom mid-pump retaining ring 50 also has matching bolt holes formed into ring 50 such that they align and mate with the bolt holes in top mid-pump retaining ring 30. Inlet ring 46 also has six bolt holes formed and spaced around its perimeter such that the bolt holes of inlet ring 46 align and mate with a liquid inlet source (not shown).

Drive mechanism retaining ring 26 is placed on one end of top cylindrical tube 22 aligning the inside diameters of ring 26 with tube 22 and welding ring 26 to tube 22. Top mid-pump retaining ring 30 is placed on the other end of cylindrical tube 22 such that the side of ring 30 having recess 31 is facing away from tube 22. Again, the 5.75-inch inside diameters of ring 30 and tube 22 are aligned then ring 30 is welded to tube 22. As previously discussed, an indexing ring may be used to facilitate the aligning process.

A hole having a diameter of about 8.5 inches is machined or cut through inlet ring 46 and bottom mid-pump retaining ring 50 such that each ring 46 and 50 fits around bottom cylindrical tube 42. Inlet ring 46 is placed around the end of bottom cylindrical tube 42 furthest away from the two-inch side wall hole and positioned along tube 42 such that a flange of about ½ inch is formed. Inlet ring 46 is then welded in place. Bottom mid-pump retaining ring 50 is placed on the end of cylindrical tube 42 nearest the two-inch side wall hole and positioned along tube 42 such that a flange of about ½ inch is formed. Bottom mid-pump retaining ring 50 is then welded in place. A two-inch diameter coupler is then aligned with the two-inch side wall hole and welded in place forming coupler 52. Assembly of pump 1 using pump housing 10 of the present invention is within the knowledge of those skilled in the art and will not be discussed.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A pump housing for an abrasive, viscous liquid pump, said housing comprising:

a bottom housing portion having a first bottom end, a second bottom end and an outlet through a wall of said bottom housing portion and spaced from said second bottom end, said bottom housing defining a first cylindrical volume; and a top housing portion having a first top end and a second top end, said second top end removably connected to said second bottom end of said bottom housing portion, said top housing portion defining a second cylindrical volume having a smaller diameter than said first cylindrical volume wherein said first cylindrical volume communicates with said second cylindrical volume defining a two-tiered cylindrical volume for receiving a piston component having a first piston assembly sized to sealably engage against an inner surface of said bottom housing portion and a second piston assembly having a smaller diameter than said first piston assembly and sized to sealably engage against an inner surface of said top housing portion and to prevent the abrasive, viscous liquid within said pump from passing upwardly around said second piston assembly in response to downward movement of said piston component within said pump.

2. The housing of claim 1 further comprising a seal between said bottom housing portion and said top housing portion.

3. The housing of claim 2 wherein said bottom housing portion further includes a bottom end recess in said second bottom end for positioning said seal.

4. The housing of claim 3 wherein said top housing portion further includes a top end recess in said second top end for mating with said seal positioned in said bottom end recess of said bottom housing portion.

5. The housing of claim 1 wherein said second bottom end has a flange and said second top end has a recess for mating engagement of said flange to said recess.

6. The housing of claim 5 further comprising a seal between said flange and said recess.

7. The housing of claim 1 wherein said second top end has a flange and said second bottom end has a recess for mating engagement of said flange to said recess.

8. The housing of claim 7 further comprising a seal between said flange and said recess.

9. An viscous liquid pump for pumping abrasive or viscous liquids, said pump comprising:

a pump housing having a bottom housing portion with a bottom end and a bottom mating end and a top housing portion with a top end and a top mating end, said top housing portion being removably attached at said top mating end to said bottom housing portion at said bottom mating end, said pump housing defining a continuous volume having an outlet through the wall of said bottom housing portion spaced from said top housing portion, said bottom end adapted for attachment to a liquid source and said top end adapted for attachment to a drive mechanism; and a piston component having a piston rod, a top piston assembly having at least one sealing component for sealable engagement against an inner surface of said top housing portion and a bottom piston assembly having at least one sealing component for sealable engagement against an inner surface of said bottom housing portion, said piston component configured for slidable movement within said continuous volume, said piston rod further including a check valve assembly positioned adjacent said bottom piston assembly for allowing liquid to conditionally pass from one side to the other of said bottom piston assembly.

10. The pump of claim 9 further comprising a seal between said bottom housing portion and said top housing portion.

11. The pump of claim 10 wherein said bottom housing portion further includes a bottom recess in said bottom mating end for positioning said seal.

12. The pump of claim 11 wherein said top housing portion further includes a top recess in said top mating end for mating with said seal positioned in said bottom recess of said bottom housing portion.

13. The pump of claim 9 wherein said top mating end has a flange and said bottom mating end has a recess for mating engagement of said flange to said recess.

14. The pump of claim 13 further comprising a seal between said flange and said recess.

15. The pump of claim 9 wherein said bottom mating end has a flange and said top mating end has a recess for mating engagement of said flange to said recess.

16. The pump of claim 15 further comprising a seal between said flange and said recess.

17. A method of making an improved high pressure liquid pump housing, said method comprising:

obtaining a bottom cylindrical casing having a first bottom end and a second bottom end, said bottom casing dimensioned to be substantially similar to a lower housing portion of a single unit high pressure pump housing;

obtaining a top cylindrical casing having a first top end and a second top end, said top casing dimensioned to be substantially similar to an upper housing portion of said single unit high pressure pump housing;

forming a first bottom casing securing ring dimensioned to slidably fit around said bottom cylindrical casing;

fixedly attaching said first bottom casing securing ring to said bottom casing spaced from said first bottom end in substantially the same position as a securing ring located at a bottom of said single unit pump housing;

forming a second bottom casing securing ring having an outside diameter similar to said first bottom securing ring and an inside diameter substantially similar to an outside diameter of said bottom cylindrical casing;

fixedly attaching said second bottom casing securing ring to said bottom casing spaced from said second bottom end creating a flange of about 0.5 inches;

forming a first top casing securing ring dimensioned to slidably fit around said top casing;

fixedly attaching said first top casing securing ring to said top casing at said first top end in substantially the same position as a securing ring located at a top of said single unit pump housing;

forming a second top casing securing ring having an outside diameter substantially similar to said second bottom casing securing ring, an inside diameter dimensioned about the same size as an internal diameter of said top cylindrical casing, and a recess sized to receive said flange;

fixedly attaching said second top casing securing ring to said top casing at said second top end.

18. The method of claim 17 further comprising forming a recess in a surface of said second bottom ring adjacent said top casing wherein said recess has a diameter sized to receive said top casing.

19. The method of claim 18 wherein said step of fixedly attaching said second top casing securing ring further includes attaching said second top ring spaced from said second top end a sufficient distance for mating with said recess.

20. The method of claim 17 further comprising forming a recess in a surface of said second top ring adjacent said bottom casing wherein said recess has a diameter sized to receive said bottom casing.

21. The method of claim 20 wherein said step of fixedly attaching said second bottom casing securing ring further includes attaching said second bottom ring spaced from said second bottom end a sufficient distance for mating with said recess.

22. The method of claim 17 further including forming a seal recess in a surface of said second bottom casing securing ring adjacent said top casing.

23. The method of claim 17 further including forming a seal recess in a surface of said second top casing securing ring adjacent said bottom casing.

24. A method of making an improved high pressure pump housing, said method comprising:

obtaining a single-unit high pressure pump housing having a top housing portion and a bottom housing portion, said bottom housing portion having an outlet through the wall of said bottom housing portion and spaced from said top housing portion;

cutting and removing said top housing portion from said bottom housing portion at the junction between said top housing portion and a mid-pump ring;

forming a replaceable top housing portion having a top cylindrical housing with a drive mechanism retaining ring dimensioned for connecting to a pump drive mechanism on one end and a top mid-pump retaining ring dimensioned for connecting to said mid-pump ring on a second end;

inserting a piston component made for sliding engagement in said single-unit high pressure pump housing; and attaching said replaceable top housing portion to said bottom housing portion.

* * * * *